US007255086B2

(12) United States Patent
Kovalenko

(10) Patent No.: US 7,255,086 B2
(45) Date of Patent: Aug. 14, 2007

(54) ROTARY INTERNAL COMBUSTION ENGINE

(76) Inventor: Vyacheslav I. Kovalenko, M. Krivonosa Lane, #9, Chigirin, Cherkassk region (UA) 20900

( * ) Notice: Subject to any disclaimer, the term of this patent is extended or adjusted under 35 U.S.C. 154(b) by 0 days.

(21) Appl. No.: 11/374,321

(22) Filed: Mar. 13, 2006

(65) Prior Publication Data

US 2006/0150949 A1 Jul. 13, 2006

Related U.S. Application Data

(63) Continuation of application No. PCT/UA2004/000067, filed on Sep. 10, 2004.

(30) Foreign Application Priority Data

Sep. 15, 2003 (UA) ..... 2003098472
Aug. 16, 2004 (UA) ..... 20040806842

(51) Int. Cl.

| | |
|---|---|
| ***F02B 53/00*** | (2006.01) |
| ***F01C 1/07*** | (2006.01) |
| ***F01C 1/00*** | (2006.01) |
| ***F16H 1/28*** | (2006.01) |
| ***F16H 21/18*** | (2006.01) |
| ***F16H 37/12*** | (2006.01) |
| *F04C 18/00* | (2006.01) |

(52) U.S. Cl. ..... 123/245; 418/36; 475/11; 74/48; 74/52

(58) Field of Classification Search ..... 123/245, 123/18 R, 43 B; 418/34–38
See application file for complete search history.

(56) References Cited

U.S. PATENT DOCUMENTS

| | | | | |
|---|---|---|---|---|
| 1,676,211 A | | 7/1928 | Bullington | 418/36 |
| 2,328,799 A | * | 9/1943 | Gaylord | 123/43 B |
| 3,476,056 A | * | 11/1969 | Bright | 418/36 |
| 4,026,249 A | | 5/1977 | Larrea | 123/245 |
| 4,136,661 A | * | 1/1979 | Posson | 418/36 |
| 5,304,048 A | * | 4/1994 | Huang | 418/36 |
| 5,740,765 A | * | 4/1998 | Ball et al. | 418/36 |
| 6,071,098 A | * | 6/2000 | Richards | 418/36 |
| 6,357,397 B1 | * | 3/2002 | Kull et al. | 123/18 R |
| 6,739,307 B2 | * | 5/2004 | Morgado | 123/245 |

FOREIGN PATENT DOCUMENTS

| | | | |
|---|---|---|---|
| DE | 4031272 A1 | * | 4/1992 |
| DE | 4209444 A1 | * | 9/1993 |
| EP | 530771 A1 | * | 3/1993 |
| JP | 2001-336402 | | 12/2001 |
| RU | 2159342 | | 11/2000 |
| WO | WO1986/001255 | | 2/1986 |
| WO | WO 9534750 A | * | 12/1995 |

* cited by examiner

*Primary Examiner*—Thai-Ba Trieu
(74) *Attorney, Agent, or Firm*—Houston Eliseeva LLP

(57) ABSTRACT

The invention can be used for transport means, sports cars and power plants. The inventive engine comprises a hollow toroidal working cylinder provided with a continuous circular slot embodied along the small diameter thereof, a nozzle or a spark plug and arc-wise extended input and output orifices embodied in the wall thereof for admitting air or air-fuel mixture and exhausting combustion gases. The transmission gear is provided with four eccentrics whose crankshaft necks are fixed to the axial holes of the pinions and arranged in the four bores of a fly wheel, whose axes are circumferentially disposed at an even pitch. The crankshaft necks are connected to the bearing elements through connecting rods each of which is arranged by the ends thereof in such a way that they are rotatable about the crankshaft neck and an axis disposed in the wall of one of the bearing elements.

5 Claims, 10 Drawing Sheets

ROTARY INTERNAL COMBUSTION ENGINE

RELATED APPLICATIONS

This application is a Continuation of PCT application serial number PCT/UA2004/000067, filed on Sep. 10, 2004, which in turn claims priority to Ukranian application serial number UA2003098472 filed on Sep. 15, 2003 and Ukranian application serial number UA20040806842 filed on Aug. 16, 2004, both of which are incorporated herein by reference in their entirety.

FIELD OF THE INVENTION

The invention relates to volumetric-displacement rotary internal combustion engines and can be used for transport means, sports cars, and power-generating installations.

BACKGROUND OF THE INVENTION

Known in the art are reciprocating internal combustion engines provided with pistons carrying out reciprocal motion inside cylinders, and an output crankshaft.

Also known in the art is a rotary internal combustion engine comprising a hollow torus-shaped working cylinder provided with a water jacket; a through continuous circular slot whose walls are symmetrically disposed relative to the central plane of the cylinder around the smallest-diameter surface thereof; an injector or a spark plug; arc-shaped extended intake and exhaust ports provided in the wall for intake of air or an air-fuel mixture and for exhaust of combustion gases; a circular housing symmetrically disposed relative to the central axis of the cylinder and provided with side walls, mounted in the working cylinder for displacement along the internal surface thereof; four pistons shaped to conform this surface and provided with compression and oil-scraper rings close to ends thereof (U.S. Pat. No. 4,026,249). In addition, this prior art engine is provided with an output shaft mounted for rotation within side walls of the housing about the central axis of the working cylinder and provided with a flywheel disposed symmetrically relative to the central plane of the cylinder; two bearing members disposed on both sides of the flywheel, each of said members comprising radially arranged ring and a disc-shaped C-wall provided with diametrically opposite slots and mounted on the output shaft for rotation thereabout. Two pistons of this engine are fastened in a diametrically opposite relationship on one ring, and two pistons, on the other ring, thereby forming inter-piston chambers between the pistons that are fastened on different bearing members. In such design, shape and size of the rings are chosen proceeding from the condition of their mounting inside the circular slot for tight contact between external surfaces of the rings and compression and oil-scraper rings, and for sealing the gaps between end faces of said rings, as well as between other end faces thereof and circular slot walls. This rotary engine is provided with a transmission gear joining the bearing members with the output shaft and comprising two toothed gearwheels in the form of external-mesh gearwheels that are fastened on the side walls of the housing, four satellite gears coupled with the flywheel, two of said satellite gears being in engagement with one toothed gearwheel and coupled with one bearing member, and two other gearwheels engaged with the other toothed gearwheel and coupled with the other bearing member. The pivot pin of each satellite gear connected with one bearing member is disposed between pivot pins of the satellite gears coupled with the other bearing member. In addition, the engine comprises two eccentric members provided with two main journals mounted for rotation inside flywheel openings, said openings being parallel to the flywheel axis and disposed in a diametrically opposite arrangement on the same circumference, and four crankpins disposed at the ends of the main journals in eccentric arrangement, each said crankpin being passed through one of the radial slots provided in the wall of one of the bearing members, and into the opening of one of the satellite gears. In this prior-art design of the rotary internal combustion engine, the ratio between diameters of satellite gears and toothed gearwheels is 1:2; the planes passing through the axes of main journals and crankpins of each pair of adjacent eccentric members intersect at an angle of 90°, and the distance between the crankpins in the areas of top and bottom dead centers is minimal.

In the above-described rotary engine, all the pistons are rotating in the same direction; in so doing, adjacent pistons are either drawing together or moving away from one another, thereby providing a decrease/increase in the volumes of inter-piston chambers, and thereby ensuring, in the process of rotation of each of the inter-piston chambers, the possibility of executing successive strokes: intake of air and fuel or an air-fuel mixture in the chamber, compression of the air-fuel mixture; ignition of the above mixture accompanied by expansion of combustion gases, and exhaust of said gases from the chamber.

As against a regular reciprocating engine, the rotary engine features the following advantages. First, in the rotary engine all the pistons are disposed within the same cylinder, i.e. they are arranged in the circular rather than longitudinal direction, thereby allowing to reduce longitudinal dimensions of the engine; second, the pistons are moving in the circular rather than radial direction; as a result, the rotary engine is much more compact than the reciprocating one. In addition, arrangement of all the pistons within one cylinder and their rotation in the circular direction result in a lower materials consumption of such engine. At the same time, conversion of rotation of the pistons to rotation of the output shaft is accomplished through the use of four eccentric members rather than via a massive crankshaft, thereby also reducing the materials consumption of the engine. Meanwhile, the major advantage of the rotary engine consists in that its pistons are not reciprocating but rather constantly moving in one direction, although at alternate speeds, thereby resulting in substantially lower consumption of energy required to overcome the inertia of pistons in a change of the sign of their acceleration for an opposite one, and hence in an increase of the engine specific power and performance index. In the rotary engine, supply of air or air-fuel mixture to the cylinder and exhaust of combustion gases are carried out by closing and opening intake and exhaust ports by pistons in the course of their travel within the cylinder, thereby eliminating the need in a complicated multicomponent control gear comprising a camshaft coupled with the crankshaft, as well as lifters, rocker arms, and valves: all this simplifies engine design and improves reliability of its operation, while eliminating consumption of energy for driving this control gear.

However, in the above-described engine the couplings between the flywheel, bearing members, and satellite gears are executed via crankpin—radial slot kinematic pairs that operate under kinetic friction conditions and great contact loads, thereby causing substantial friction in these pairs and resulting in substantial abrasion of the walls of radial slots and crankpins, and hence in an increase of gaps therebetween; all this results in emergence of impact loads that disturb normal operation of the engine. At the same time, satellite gears do not have any axial bearings since these satellite gears are coupled with the flywheel by means of crankpins disposed in these satellite gears in eccentric arrangement relative to the axes of rotation thereof; therefore, the crankpins exert high pressure forces to hold satellite gears together with the toothed gearwheels during rotational movements of the crankpins toward said toothed gearwheels, and pull the crankpins away from the toothed gearwheels during rotational movements of the crankpins in the opposite direction. Such an arrangement creates great radial loads on the satellite gears and toothed gearwheels, and causes fluctuating bending stresses in the crankpins, and hence fluctuating loads on all the components of the transmission gear. Elevated loads in meshes between satellite gears and gearwheels cause substantial friction forces in such meshes, which in addition to substantial friction forces in the crankpin—radial slot kinematic pairs results in considerable losses of energy, and hence in an insufficient performance index of the engine. Considerable loads in meshes, as well as impact loads in crankpin—radial slot pairs result in an inadequate reliability of the engine and insufficient interrepair life thereof. At the same time, rigid couplings between the components of the transmission gear, carried out via two eccentric members, impose restraints on setting a mode of variation of the speed of relative travel of the bearing members, and result in an additional increase in the loads on the transmission gear components.

SUMMARY OF THE INVENTION

Proceeding from aforementioned, the present invention is based on the object of improving the rotary internal combustion engine by way of providing rotational couplings between each of satellite gears and the flywheel and the bearing member, with inclusion of axial bearings for satellite gears in the transmission gear, thereby allowing to eliminate impact loads on the components of said transmission gear, to reduce loads on said components and power consumption required for overcoming friction in said components, and to provide more flexible couplings therebetween, and hence to increase the performance index of the engine, reliability and interrepair time thereof, while reducing dimensions and mass of the components of the transmission gear, and to extend the capabilities of setting the mode of variation of the speed of relative travel of the bearing members.

The object set forth is attained by that in a rotary internal combustion engine comprising a hollow torus-shaped working cylinder provided with a water jacket; a through continuous circular slot whose walls are symmetrically arranged relative to the central plane of the cylinder around the smallest-diameter surface thereof; an injector or a spark plug; arc-shaped extended intake and exhaust ports provided in the wall for intake of air or an air-fuel mixture and for exhaust of combustion gases; a circular housing symmetrically disposed relative to the central axis of the cylinder and provided with side walls, and also provided with four pistons mounted in the working cylinder for travel along the internal surface thereof and shaped to conform this surface and provided with compression and oil-scraper rings near end faces thereof, and in addition provided with an output shaft mounted for rotation within said side walls of the housing along the central axis of the working cylinder, and a flywheel fastened on the output shaft or being integral therewith, and two bearing members symmetrically arranged relative to the central plane of the cylinder, each of said members comprising radially arranged ring and a C-wall mounted for rotation about the axis of the output shaft, and wherein, in addition to the above-listed, two pistons are fastened in a diametrically opposite arrangement on one ring, and two pistons, on the other ring, thereby forming inter-piston chambers between the pistons that are fastened on different bearing members; in so doing, shape and size of the rings are chosen proceeding from the condition of their mounting within the circular slot for tight contact between external surfaces of the rings and compression and oil-scraper rings, and for sealing the gaps between end faces of said rings, as well as between other end faces thereof and circular slot walls, and finally wherein there is provided a transmission gear comprising two toothed gearwheels in the form of external-mesh gearwheels that are fastened on the side walls of the housing and are provided with axial openings for the passage of the output shaft; four satellite gears coupled with the flywheel, two of said satellite gears being in engagement with one toothed gearwheel and coupled with one bearing member, and two other gearwheels engaged with the other toothed gearwheel and coupled with the other bearing member, the axis of rotation of each satellite gear coupled with one bearing member being disposed between axes of rotation of the satellite gears coupled with the other bearing member; eccentric members coupling the satellite gears with the flywheel and the bearing members, and provided with two main journals mounted within flywheel openings, said openings being parallel to the flywheel axis, and four crankpins coupled with the bearing members, the ratio between diameters of satellite gears and toothed gearwheels being 1:2; the planes passing through the axes of the main journals and crankpins of each pair of adjacent eccentric members intersecting at an angle of 90°, and the distance between crankpins in the areas of top and bottom dead centers being minimal, wherein according to the present invention, the transmission gear is provided with four eccentric members whose main journals are disposed at a uniform pitch along circumference and are either fastened within the axial openings of the satellite gears or made integral therewith, and the crankpins are coupled with the bearing members by means of coupler links, each coupler link being mounted with the ends thereof for rotation on the crankpin and about the pivot pin disposed in the wall of one of the bearing members.

Provision of the transmission gear with four instead of two eccentric members mounted with main journals thereof within four openings provided in the flywheel and having no rigid coupling therebetween, and availability of couplings between the crankpins and the bearing members via the coupler links result in elimination of the crankpin—radial slot pairs that operate under conditions of kinetic friction and great contact loads, thereby imparting all the couplings between the bearing members and the flywheel rotational nature and making them more loose, which results in a decrease in consumption of energy required to overcome the friction between the components of the transmission gear, and expands the possibilities of setting a mode of variation of the speed of relative travel of the bearing members provided with the pistons. At the same time, the above rotational couplings eliminate abrasion of interacting surfaces and resulting emergence of impact loads within the transmission gear. Fastening of the main journals within the satellite gears along axes of rotation thereof results in the reduction of loads, and hence of the friction in toothed meshes, and eliminates any substantial alternate stresses in the transmission gear components. All this permits to reduce costs required to overcome the friction between the transmission gear components, to reduce the loads exerted thereon, and hence to increase the performance index of the engine, reliability and interrepair life thereof, while decreasing dimensions and mass of the transmission gear components.

In so doing, the bearing members of the inventive rotary engine may be disposed on both sides of the central plane of the cylinder, with a gap provided between the walls of said bearing members; the flywheel is composed of two radially arranged discs, each of them being disposed between one of the toothed gearwheels and one of the bearing members, and two radially arranged rings, each of them being disposed between one of the housing side walls and one pair of the satellite gears, and coupled with one of the discs by means of two arc-shaped plates passed between the points of engagement of toothed gearwheels with satellite gears, the main journals of the satellite gears meshed with one toothed gearwheel being mounted within the openings of one ring, and the main journals of the satellite gears meshed with the other toothed gearwheel, within the openings of the other wheel. Such arrangement results in a small axial length of the bearing members since their walls are disposed at an insignificant distance from one another in the axial direction; this however also somewhat complicates the flywheel design, increases the number of parts, and complicates the technology of assembling such engine.

In the best mode of the engine, the bearing members are disposed on both sides of the central plane of the cylinder, with a gap provided between the walls of said bearing members; the flywheel is composed of two radially arranged discs and two radially arranged rings, each of the discs being disposed between one of the toothed gearwheels and one of the bearing members, and each of the rings, between one of the housing side walls and the satellite gears, and coupled with one of the discs by means of four arc-shaped plates passed between four points of engagement of toothed gearwheels and satellite gears, each of the satellite gears being composed of two twin gearwheels fastened on the main journal thereof on both sides of the pair of the bearing members, and the main journal rigidly connected with the crankpin, the main journal of each satellite gear being mounted within coaxial openings of both flywheel rings; one of the twin gearwheels is meshed with one of the toothed gearwheels, and the other gearwheel, with the other toothed gearwheel; the coupler link connecting each of the satellite gears with the bearing member is disposed within the gap between twin gearwheels of the satellite gear and is composed of two parallel plates that are rigidly interconnected with formation of a gap therebetween, said gap enclosing the wall of the bearing member, coupled with this satellite gear, the walls of the bearing members being made in the shape of plates or discs connecting the piston pairs, each of the discs being provided with four openings; arrangement and sizes of the plates or openings provided in the discs are chosen proceeding from the condition of absence of any contacts between main journals and crankpins of the satellite gears coupled with one bearing member, and plates or edges of the openings provided in the discs of the other bearing member in the course of relative travel of the bearing members.

The advantage of such embodiment of the engine consists in that the load on the teeth of satellite gears and toothed gearwheels, exerted by the bearing members, is evenly distributed between the twin gearwheels, thereby halving the load in the meshes between the satellite gears and the toothed gearwheels, and hence permitting to substantially reduce the sizes of the satellite gears and the toothed gearwheels, thereby decreasing radial dimensions of the transmission gear. In addition, making satellite gears in the twin form, their gearwheels being symmetrically arranged relative to the central plane of the cylinder, ensures symmetrical arrangement of masses of the transmission gear components on both sides of this plane along axial and radial coordinates, and hence substantially simplifies static and dynamic balancing of the engine, and reduces the timetable and costs required for such balancing. This however somewhat complicates the design of the transmission gear and assembling of the engine.

As an alternative, the flywheel may be disposed in the central plane of the cylinder, each toothed gearwheel being provided with a bushing fastened on the side wall of the housing, and the bearing members are mounted for rotation on the bushings of the toothed gearwheels between these gearwheels and housing side walls. Such arrangement results in a substantial axial length of the bearing members and their mounting on the bushings of the toothed gearwheels rather than on the output shaft, at the same time however simplifying the flywheel design and couplings thereof with satellite gears, and hence simplifies the technology of assembling such engine.

To ensure unhindered travel of the pistons within the cylinder and tightness of the inter-piston chambers from the side of end faces of the pistons, external surfaces of the rings of the bearing members may be made along the moving line in the shape of a circular arc having a diameter equal to the diameter of the internal surface of the working cylinder, and the rings are mounted within the circular slot, external surfaces thereof forming an extension of the internal surface of the cylinder. Such arrangement results in a complicated shape of external surfaces of the rings, thereby requiring a high working accuracy and precise fitting of these surfaces to the internal surface of the cylinder in the process of mounting the rings inside the circular slot.

Alternatively, the external surface of each piston may be made along the moving line in the shape of circumference, and be provided with a rectilinear section facing the circular slot, the width of said section being equal to the width of the circular slot, and external surfaces of the rings, along the moving lines in the shape of rectilinear lengths. Such arrangement simplifies the shape of rings and hence machining of their external surfaces; however it complicates the shapes of pistons, compression and oil-scraper rings.

BRIEF DESCRIPTION OF THE DRAWINGS

The invention is further explained by way of the drawings, in which.

DETAILED DESCRIPTION OF THE PREFERRED EMBODIMENTS

Figure 1:
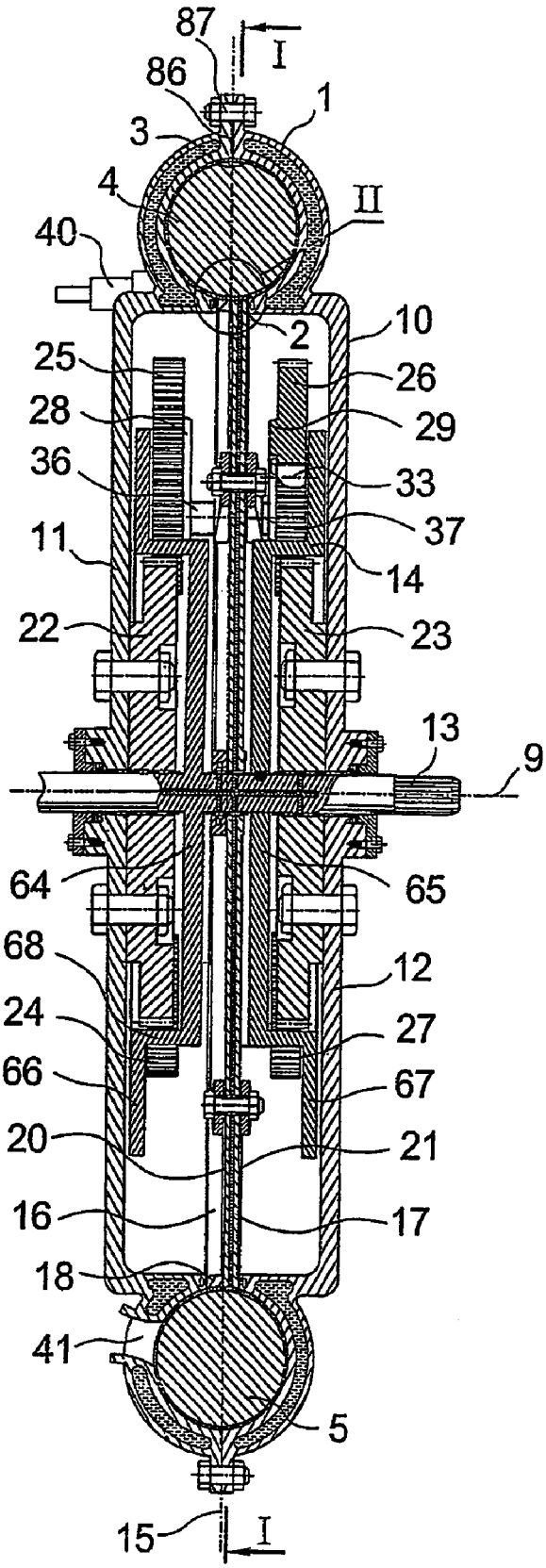
FIG. 1 shows the engine in section along the output shaft axis.

The rotary internal combustion engine comprises hollow torus-shaped working cylinder 1 (FIGS. 1 and 2) provided with through continuous circular slot 2 whose walls are symmetrically arranged relative to the central plane of cylinder 1 about the smallest-diameter surface 3 thereof; four pistons 4, 5, 6, and 7 mounted in the working cylinder for travel along the internal surface thereof, shaped to conform this surface and provided with compression and oil-scraper rings 8 near the ends thereof. The inventive engine is also provided with circular housing 10 with side walls 11 and 12, symmetrically disposed relative to central axis 9 of working cylinder 1; output shaft 13 with flywheel 14, symmetrically mounted relative to line 15 and for rotation about central axis 9 of working cylinder 1 in side walls 11 and 12; two bearing members 16 and 17 provided with rings 18 and 19, and walls 20 and 21. The engine is also provided with a transmission gear comprising two toothed gearwheels in the form of external-mesh gearwheels 22 and 23 that are fastened within housing 1 in symmetrical arrangement relative to the central plane of circular slot 2; four satellite gears 24, 25, 26, and 27, coupled with the flywheel, and four eccentric members 28, 29, 30, 31 provided with main journals 32, 33, 34, 35 and crankpins 36, 37, 38, 39. For the carburetor engine and the injection engine, spark plug 40 is mounted in the wall of cylinder 1, and arc-shaped extended intake port 41 and exhaust port 42 are provided in said wall for intake of air-fuel mixture into cylinder 1 and for exhaust of combustion gases therefrom, respectively. For the diesel engine, the spark plug is replaced by a fuel injection nozzle, and port 41 serves for intake of air into cylinder 1. Walls 20 and 21 of bearing members 16 and 17 are made in the form of plates coupling piston pairs 4, 6 and 5, 7. However, for the purpose of increasing the strength of walls 20 and 21, while keeping their thickness minimal,-these walls may be made in the shape of discs provided with ports designed to reduce the mass of discs and to facilitate access to engine components in the course of maintenance activities.

Figure 3:
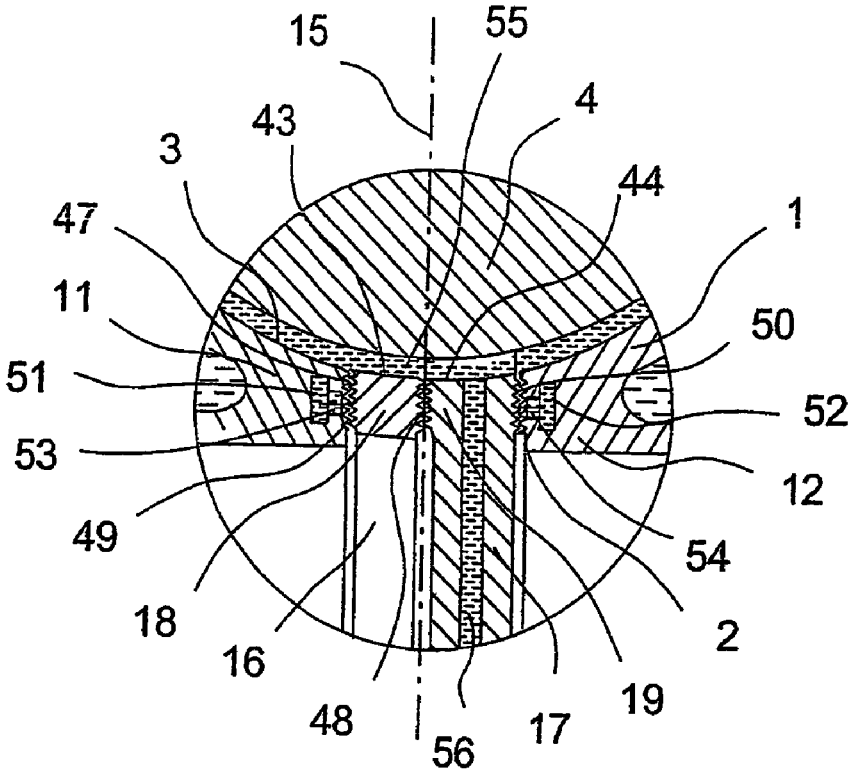
FIG. 3 shows enlarged area II of FIG. 1.

Bearing members 16 and 17 are made C-shaped in radial sections thereof and mounted on output shaft 13 for rotation thereabout and in symmetrical relationship with central plane 15 of circular slot 2, a gap being provided between their walls 20 and 21 that are coupled with rings 18 and 19 along open end faces thereof. External surfaces 43 and 44 (FIG. 3) of rings 18 and 19 of bearing members 16 and 17 are provided along the moving lines in the shape of arcs of a circumference having a diameter equal to the diameter of the internal surface of working cylinder 1, and radial sizes of rings 18 and 19, i.e. distances of their external surfaces 43 and 44 from central shaft 9 of cylinder 1 are so selected that when mounting rings 18 and 19 in circular slot 2 their external surfaces 43 and 44 form, inside slot 2, an extension of the internal surface of cylinder 1, thereby providing a tight contact between surfaces 43, 44 and compression and oil-scraper rings 8 of pistons 4 through 7, and hence sealing of the inter-piston chambers and free travel of pistons 4 through 7 inside cylinder 1. However, the complicated shape of external surfaces 43, 44 of rings 18, 19 requires a high accuracy of their machining and fitting of these surfaces to the internal surface of cylinder 1 in the course of mounting rings 18, 19 in circular slot 2.

Figure 4:
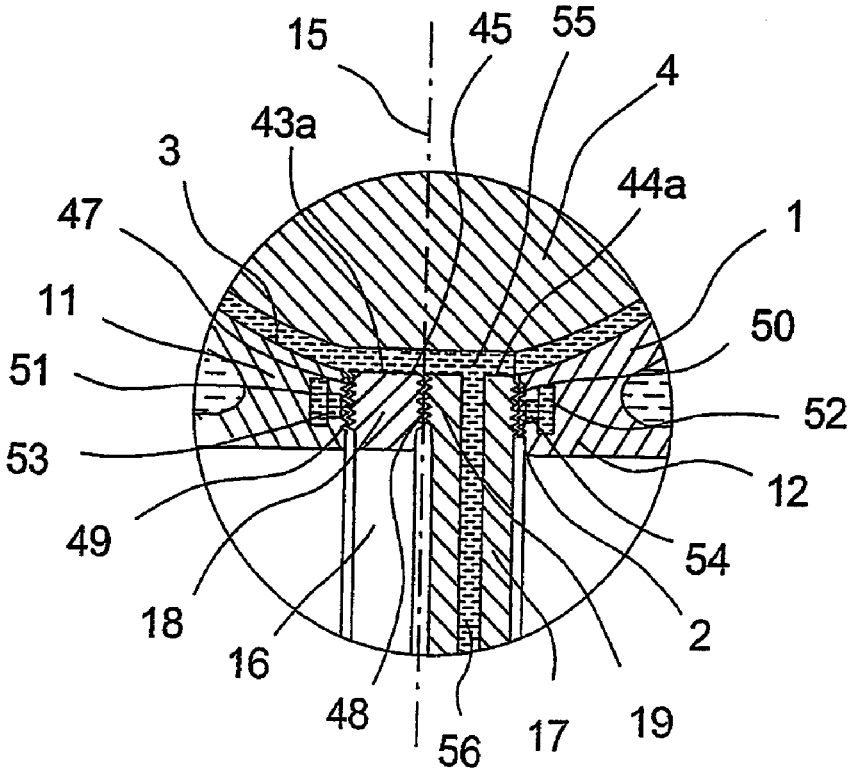
FIG. 4 shows enlarged area II of FIG. 1, where external surfaces of the rings of the bearing members are made along rectilinear moving lines.

To eliminate the above shortcomings, the surface of each of pistons 4 through 7 may be made (FIG. 4) along a moving line in the form of a circumference with rectilinear section 45 facing circular slot 2, the width of this section being equal to the width of circular slot 2, and external surfaces 43*a*, 44*a* of rings 18, 19 in the radial section thereof, in the form of rectilinear lengths along moving lines. This solution however results in a complication of shapes of pistons 4 through 7.

Figure 2:
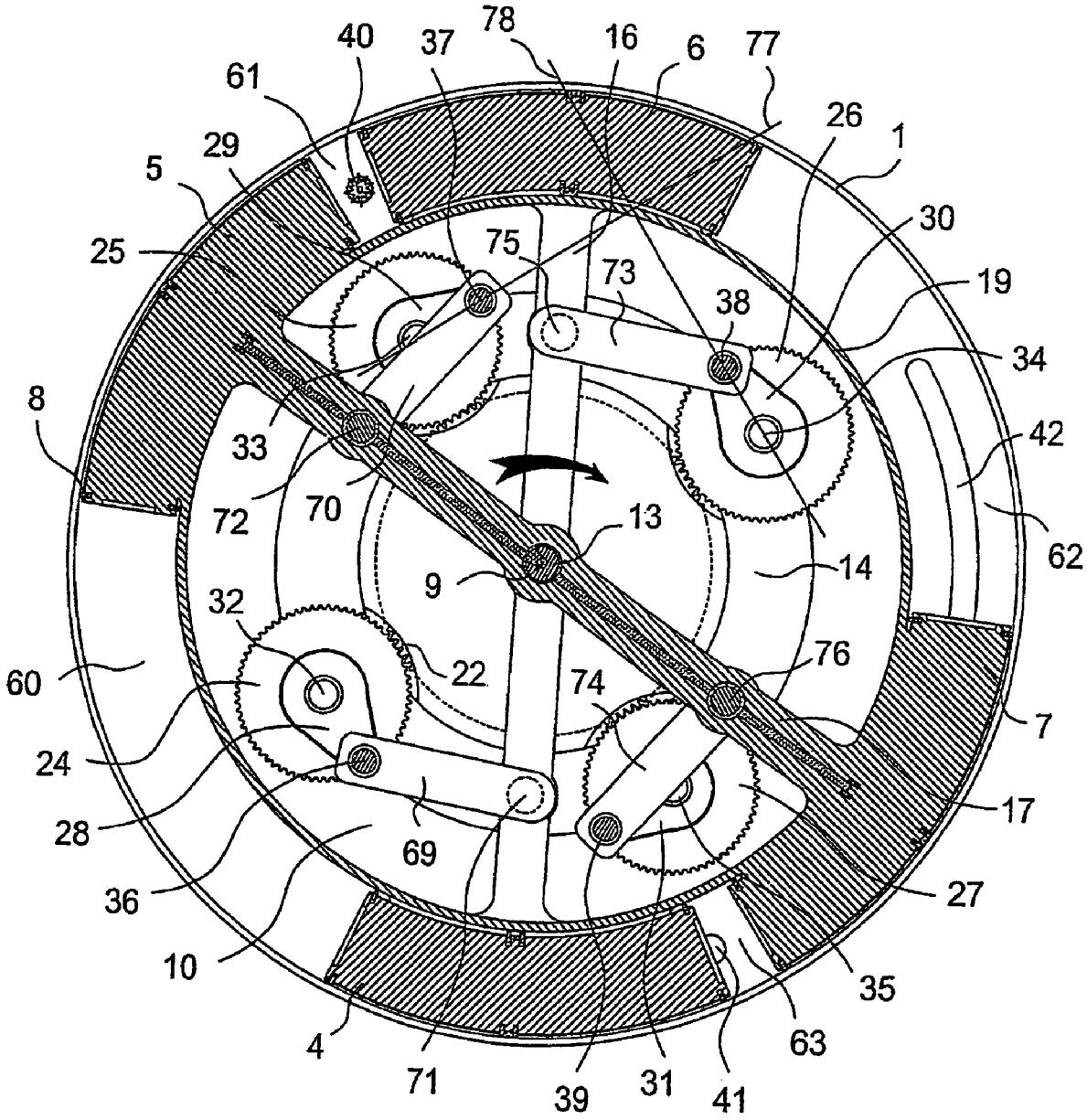
FIG. 2 shows section I-I of FIG. 1.

End faces of rings 18 and 19, as well as of the walls of circular slot 2 (FIG. 3) are provided with circular concentric grooves 47 which, upon mounting of rings 18 and 19 in circular slot 2, form labyrinth seal 48 between the end faces of rings 18 and 19, and labyrinth seals 49 and 50 between the end faces of rings 18, 19 and the walls of circular slot 2. Labyrinth seals 49 and 50 are supplied with a lubricant via circular ducts 51 and 52, provided in housing 10, and via a set of ducts 53, 54 that are connected with ducts 51, 52 and open into seals 49 and 50. Seal 48 is supplied with lubricant from circular gap 55 provided between pistons 4 through 7 and the internal surface of cylinder 1. Gap 55 is supplied with lubricant via radial duct 56 provided in wall 21 of bearing member 17, said radial duct being supplied with lubricant via an axial duct provided in shaft 13 (FIG. 2). Under the effect of centrifugal forces resulting from rotation of bearing members 16, 17, the lubricant is vented from seals 49, 50 into circular gap 55. Labyrinth seals 48, 49, 50 form ducts of variable cross-section, which fact, taken in combination with an oil film formed therein, results in a high hydraulic resistance in the way of combustion gases. Labyrinth seals may be replaced by O-rings fastened on end faces of rings 18, 19 and made of a heat-resisting material having low coefficients of thermal expansion and friction.

Pistons 4 and 6 (FIGS. 1, 2) are fastened in a diametrically opposite relationship on bearing member 16, and pistons 5 and 7, on bearing member 17, thereby forming variable-volume inter-piston chambers 60, 61, 62, 63 between pistons 4, 5, 6, and 7.

Satellite gears 24 and 26 are meshed with gearwheel 22, and satellite gears 25 and 27, with gearwheel 23.

Flywheel 14 (FIGS. 1, 5) is composed of two radially arranged discs 64 and 65, disc 64 being disposed between gearwheel 22 and bearing member 16, and disc 65, between gearwheel 23 and bearing member 17, and two radially arranged rings 66 and 67, ring 66 being disposed between side wall 11 of housing 1 and a pair of satellite gears 24, 25, and ring 67, between side wall 12 and a pair of satellite gears 26, 27. Ring 66 is coupled with disc 64 by two arc-shaped plates 68 passed between the points of engagement of gearwheel 22 with satellite gears 24, 26, and ring 67 is coupled with disc 65 by two arc-shaped plates 68 passed between the point of engagement of gearwheel 23 with satellite gears 26, 27. Main journals 32 and 34 are mounted for rotation in openings of ring 66, and main journals 33 and 35, in openings of ring 67. Axes of openings in both rings are disposed at a uniform circular pitch. Satellite gears 24 and 26 are fastened on main journals 32 and 34 of eccentric members 28 and 30, and their crankpins 36 and 38 are coupled with wall 20 of bearing member 16 by coupler links 69 and 70, mounted with their ends for rotation on these crankpins and on pins 71 and 72, fastened in wall 20 of bearing member 16. Satellite gears 25 and 27 are fastened on main journals 33 and 35 of eccentric members 29 and 31, and their crankpins 37 and 39 are coupled with wall 21 of bearing member 17 by coupler links 73 and 74, mounted with the ends thereof for rotation on these crankpins and on pins 75 and 76, fastened on wall 21 of bearing member 17. Such design of the engine makes for compactness of the pair of bearing members 16, 17, since these members are disposed at an insignificant axial distance from one another; at the same time however it also results in a complication of the design of flywheel 14, an increase in the number of parts, complication of engine design and engine assembling technology.

To ensure cycling operation of engine components in the function of angles of flywheel rotation from the top dead center, the following parameters of these components have been established. The ratio between diameters of satellite gears 24 through 27 and toothed gearwheels 22, 23 is 1:2, so that during one revolution of output shaft 13 and hence flywheel 14, each satellite gear performs two revolutions about its axis. Plane 77 passing through the axes of main journal 33 and cranikpin 37 of eccentric member 29 of satellite gear 25, intersects at an angle of 90° plane 78 passing through the axes of main journal 34 and cranikpin 38 of eccentric member 30. The planes passing through the axes of main journals and crankpins of each pair of adjacent eccentric members intersect at the same angle. Such arrangement of the above planes causes the arrangement of longitudinal axes of adjacent eccentric members (being projections of the above planes to the plane perpendicular to the axis of the output shaft) at an angle of 90°. When designing the engine by way of calculations or using a mock-up of the engine, circular sizes of pistons 4 through 7 are set depending on a selected compression ratio of the air-fuel mixture. In so doing, selected in the cylinder are locations of top and bottom dead centers (M) in the area of maximum approach of adjacent pistons, i.e. in the minimal distance between crankpins of adjacent satellite gears, and on the basis of these dead centers, determined are angular data for spark plug or incandescent plug 40, as well as angular data for intake port 41 and exhaust port 42. Selection of the lengths of coupler links 69, 70, 73, 74 and locations of their axes of rotation on walls 20 and 21 of bearing members 16, 17 is used for presetting the directions of forces applied to crankpins 35 through 39 of satellite gears 24 through 27 by bearing members 16 and 17 in the function of the angles of rotation of the output shaft, thereby defining the nature of changes of the arms of these forces, and hence the nature of changes of torques transferred to satellite gears, in the function of the angles of rotation of the output shaft, and thereby permitting to preset the nature of variation of the speed of relative travel of the bearing members, and hence to optimize parameters of the processes occurring inside the inter-piston chambers.

The cooling system of the engine is made in the same way as the system described in U.S. Pat. No. 4,026,249, and therefore is not given in this Specification. The lubricating system is constructed in compliance with the prior art principles, and is only partially presented in this Specification.

Figure 11:
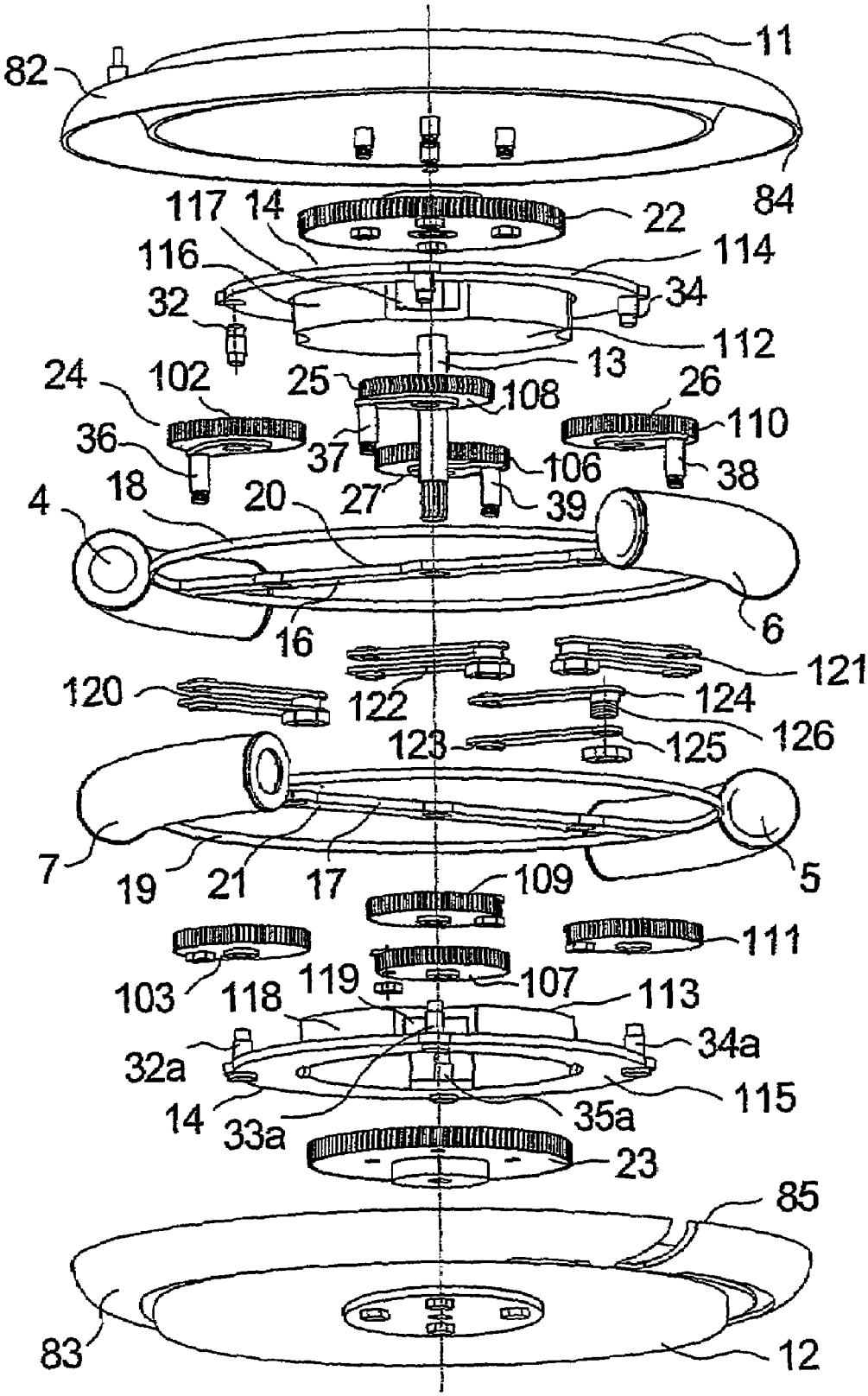
FIG. 11 shows the assembly configuration of the engine shown in FIG. 10.

Working cylinder 1 and housing 10 are made of two halves 82 and 83 (FIGS. 1, 3, and 11) provided with circular flanges 84 and 85, and with circular sealing washer 86 mounted therebetween. Flanges 84 and 85 are interconnected by way of bolted joints 87. Washer 86, together with labyrinth seals 48, 49, 50, provide tightness of the cavity of working cylinder 1.

When assembling the engine, pistons 4 and 6 with bearing member 16 made integral therewith are mounted into one of halves 82, 83, and pistons 5 and 7 with bearing member 17, into the other half. Output shaft 13 with flywheel 14, and components of the transmission gear are inserted into the space between side walls 11 and 12; washer 86 is mounted between flanges 84 and 85; both halves of working cylinder 1 are connected to dispose pistons 4 and 6 between pistons 5 and 7, and rings 18 and 19, in circular slot 2; following this, and halves 82 and 83 of cylinder 1 are fastened together by bolted joints 87.

The engine operates as follows.

Figure 5:
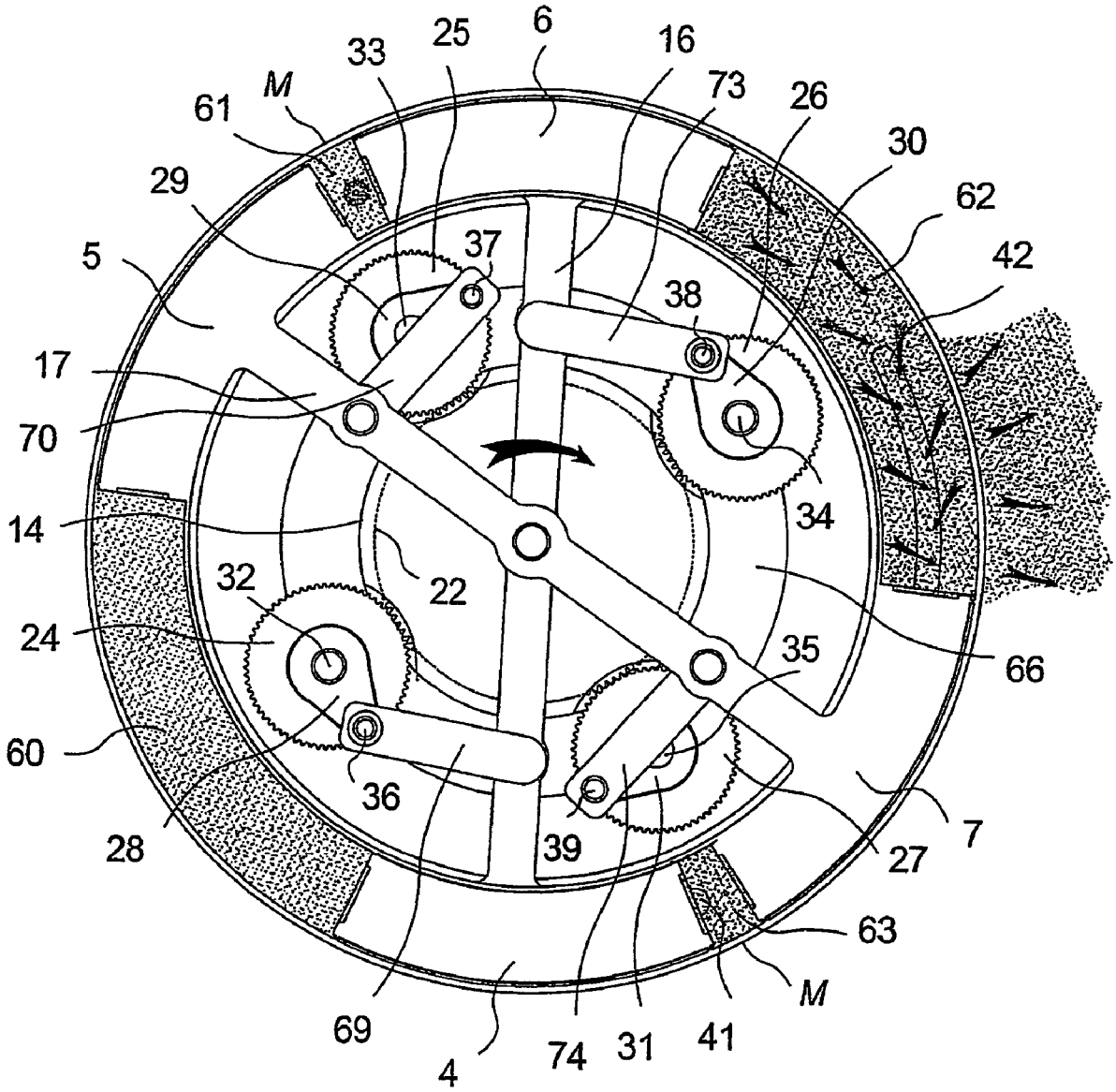
FIGS. 5 through 8 show the kinematics of the engine with four various positions of its components during one revolution of the output shaft.
Figure 6:
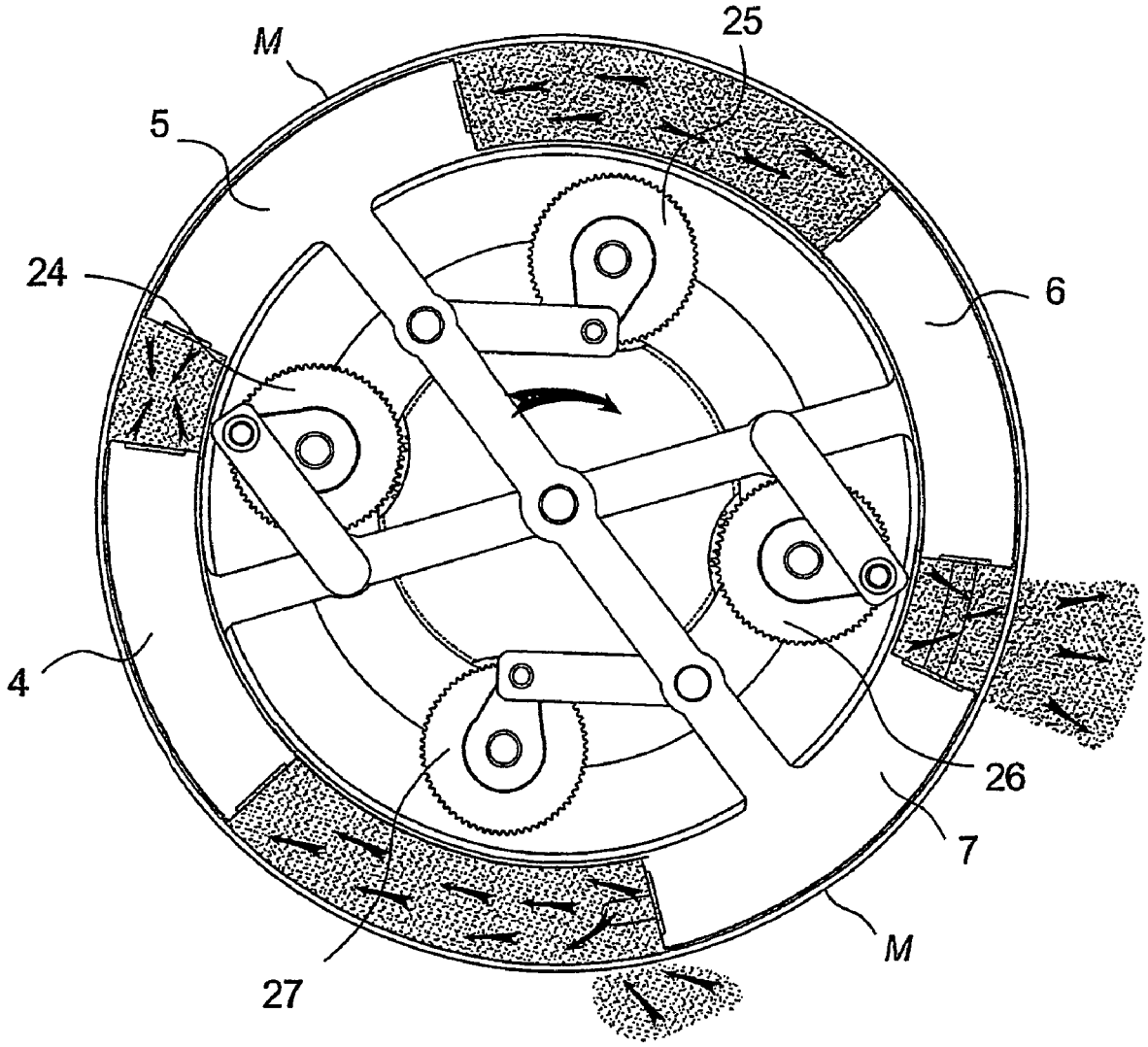

FIG. 5 demonstrates the kinematics of the engine at the moment when, upon spinup thereof by the starter, pistons 5 and 6 are disposed in the area of the top dead center, M, and inter-piston chamber 61 formed between said pistons and containing an air-fuel mixture compressed to a maximum extent is at the beginning of the area of ignition of the air-fuel mixture and expansion of combustion gases. Piston 7 has opened exhaust port 42, and inter-piston chamber 62 is disposed at the end of the area of exhaust of combustion gases. Piston 4 starts opening intake port 41, and inter-piston chamber 63 is disposed at the beginning of the area of intake of the air-fuel mixture. Inter-piston chamber 60 is disposed before the beginning of the compression area. The distances between crankpins 36, 39 of eccentric members 28, 31 of adjacent satellite gears 24, 27, and between crankpins 37, 38 of eccentric members 29, 30 of satellite gears 25, 26 are minimal. In the process of engine operation, longitudinal axes of eccentric members of adjacent satellite gears are constantly taking positions in which axes thereof intersect at an angle of 90°. FIG. 6 shows the kinematics of the engine at the moment when the process of expansion of combustion gases in inter-piston chamber 61 comes to an end, exhaust of combustion gases in chamber 62 comes to an end, intake of the air-fuel mixture in chamber 63 comes to an end, and the process of mixture compression in chamber 64 comes to an end.

The air-fuel mixture in inter-piston chamber 61 is igniting, and expanding combustion gases exert pressure on pistons 5 and 6, said pressure being of the same magnitude and acting in opposite directions. Here, piston 6 together with bearing member 16 rotates clockwise. Coupler link 73 turns eccentric member 30 clockwise, and as a result satellite gear 26, while rotating about its axis, is rolling clockwise together with main journal 34 about gearwheel 22; here, main journal 34, by acting upon the wall of the opening provided in ring 66 of flywheel 14, rotates said flywheel clockwise. At the same time, under the effect of the pressure exerted by combustion gases, piston 5 with bearing member 17 rotates counter-clockwise. Coupler link 70 rotates eccentric member 29 together with satellite gear 25 clockwise. Similarly to satellite gear 26, satellite gear 25, while rotating about its axis, is rolling clockwise together with main journal 33 of eccentric member 29 about gearwheel 23, main journal 33 also rotating flywheel 14 clockwise. Thus, pistons 6 and 5 transfer clockwise-directed torques, i.e. an overall torque, to flywheel 14. Here, forces exerted by coupler link 73 on eccentric member 30, and by coupler link 70 on eccentric member 29, are of equal magnitude; however, the arm of the force acting on eccentric member 30 is longer than the arm of force acting on eccentric member 29, and therefore the torque on eccentric member 30 is greater than the one acting on eccentric member 29. As a result, the torque transferred to flywheel 14 by eccentric member 30 is greater than the torque transferred by eccentric member 29. Bearing member 17 is acted upon by a torque created by the pressure of combustion gases on piston 5 and directed counter-clockwise, as well as by the clockwise torque from eccentric member 29, and the torque from eccentric member 29, and the torque from flywheel 14, transferred to said bearing member by main journal 34 of eccentric member 30. As a result of all the aforementioned, in the process of expansion of combustion gases inside inter-piston chamber 61, bearing member 16 with piston 6 considerably outdistance bearing member 17 with piston 5, and therefore piston 5 moves very slowly in clockwise direction, following piston 6.

At the same time, bearing member 17 moves piston 7 clockwise by the same angle as piston 5. In so doing, bearing member 17 is acted upon by an oppositely directed torque since rotating flywheel 14 is moving main journal 35 of eccentric member 31 clockwise, while eccentric member 31 rotating clockwise about its axis together with satellite gear 27, is pushing bearing member 17 counter-clockwise via coupler link 74, which constitutes another factor promoting a considerable lag of piston 5 from piston 6. Piston 6 is traveling clockwise toward almost immovable piston 7, thereby resulting in ejection of combustion gases from inter-piston chamber 62. Piston 4 is moved by bearing member 16 together with piston 6 by the same angle, while gradually opening intake port 41, and thereby carrying out supply of the air-fuel mixture into chamber 63, and at the same time approaching almost immovable piston 5, thereby carrying out compression of the air-fuel mixture inside inter-piston chamber 60.

Figure 7:
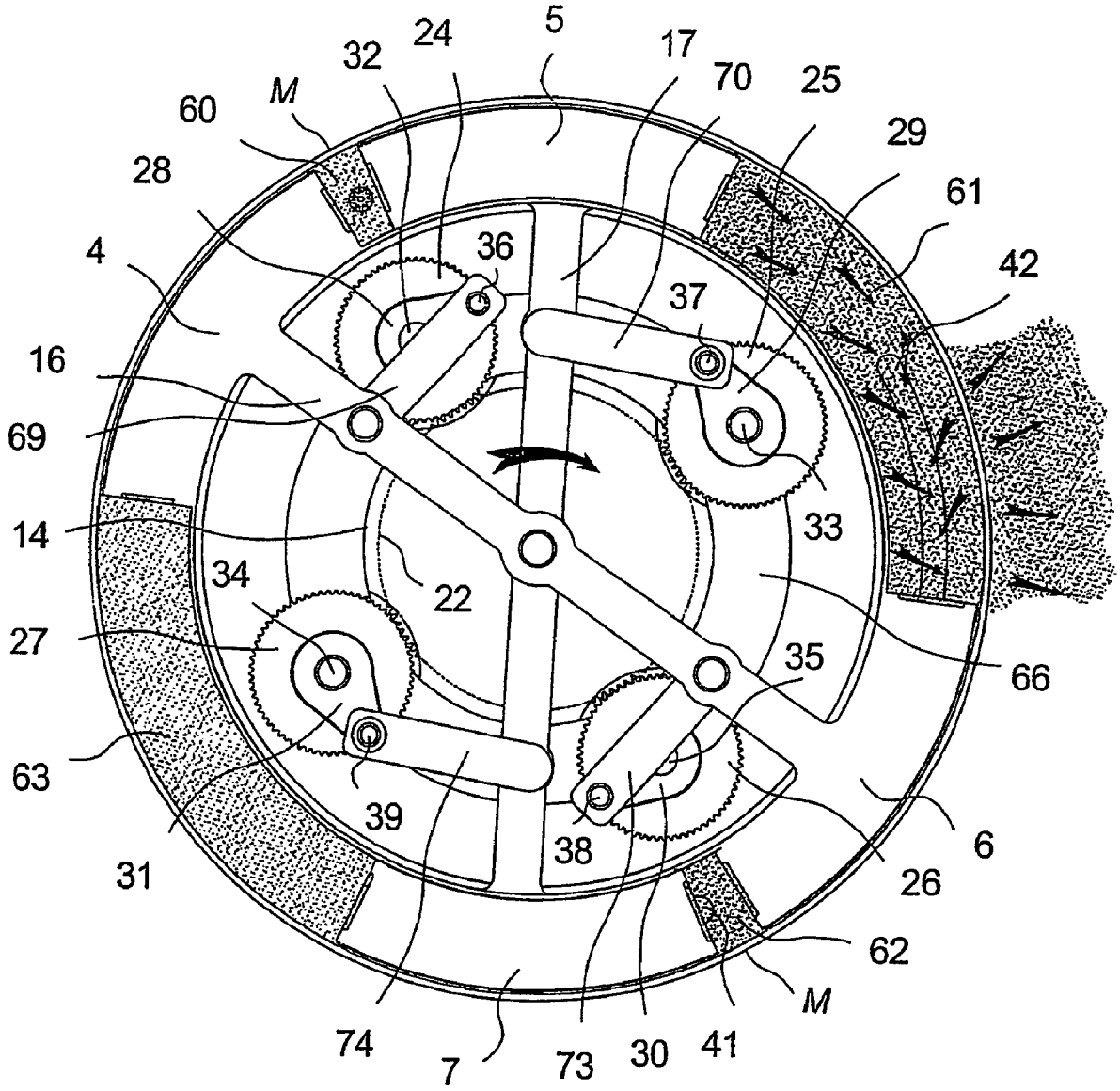
Figure 8:
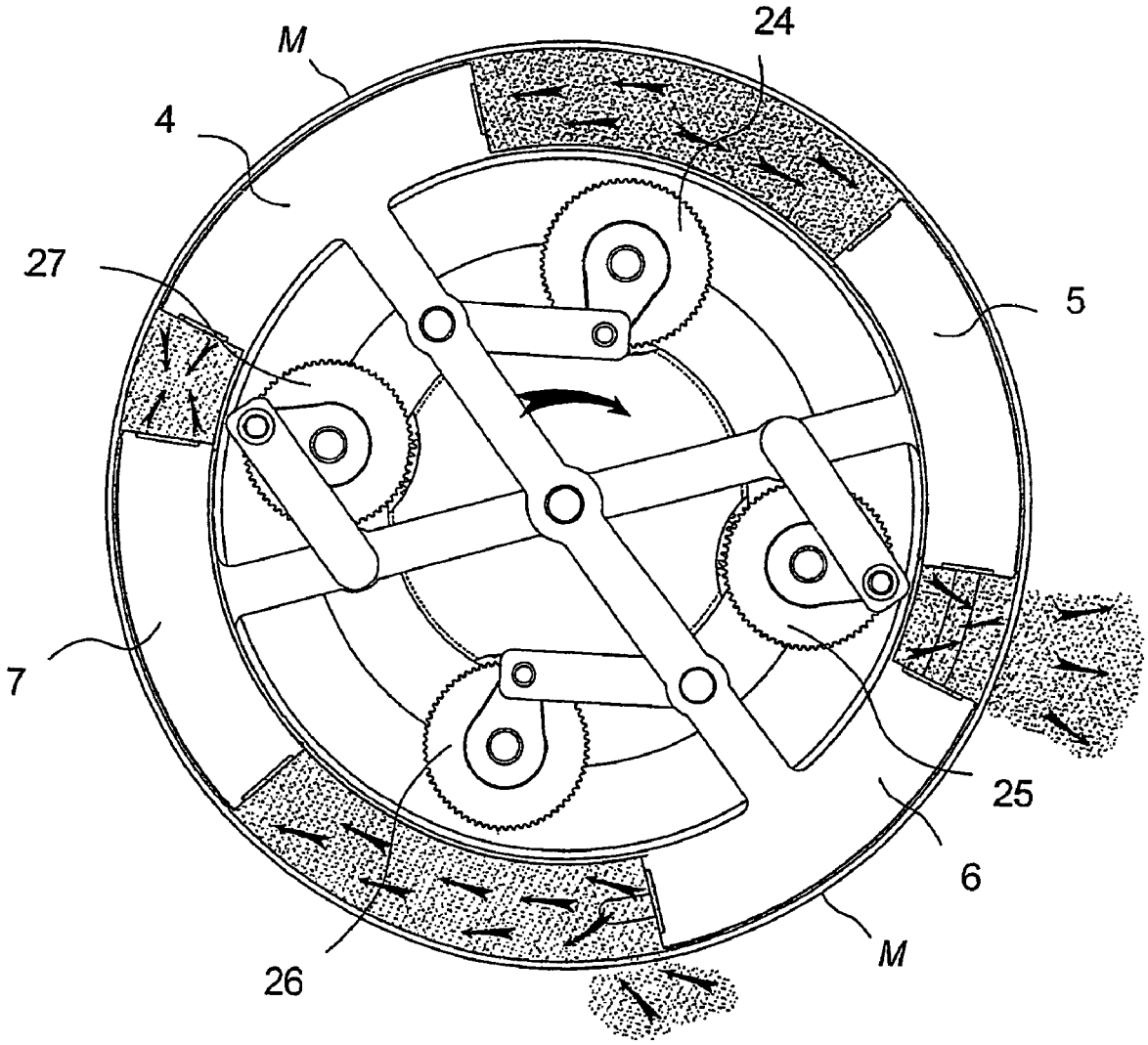

Further on, piston 5 takes the position of piston 6 (FIG. 7); piston 4 takes the position of piston 5; piston 7 takes the position of piston 4; and piston 6 takes the position of piston 7, correspondingly changing the positions of bearing members 16 and 17, and the processes that took place inside inter-piston chambers and described above for the sequence of chambers 61-62-63-60, are repeated for the sequence of chambers 60-61-62-63; as a result, pistons 5 and 7 in the course of their motion outdistance pistons 6 and 4, and components of the transmission gear, coupled with pistons 5 and 7, repeat the motions of components coupled with pistons 6 and 4. FIG. 8 shows subsequent positions of engine components, similar to those given in FIG. 6. Thus, during one revolution of output shaft 13, in each of the inter-piston chambers there occurs a sequence of processes of intake of the air-fuel mixture, its compression, ignition accompanied by expansion of combustion gases, and exhaust of these gases; during one revolution of output shaft 13, four explosion strokes occur inside various inter-piston chambers, accompanied by transfer of the energy of pistons' motion to output shaft 13.

Thus, transfer of power from pistons 4 through 7 to output shaft 13 is carried out via bearing members 16, 17 and the transmission gear containing only pairs operating with rolling friction, i.e. via coupler links 69, 70 and 73, 74, rotating with ends thereof about pins 71, 72 and 75, 76 in bearing members 16, 17, and about crankpins 36, 37 and 38, 39 of eccentric members 28, 30, 31, 33, whose main journals 32 through 35 are rotating in the openings of two rings 66, 67 of flywheel 14. As compared to the prototype engine, such arrangement considerably reduces friction in the transmission gear components and eliminates increased wear thereof. Satellite gears 24 through 27 are provided with axial supports in the form of main journals 32 through 35, thereby eliminating emergence of substantial alternate loads acting upon the transmission gear components. Couplings between eccentric members 28 through 31 and the bearing members via coupler links 69, 70, 73, 74 eliminate the need in crankpin—radial slot pairs in the bearing members, operating under kinetic friction conditions and great contact loads.

As can be seen from the description of design and operation of the internal combustion engine, it has the following main advantage over a regular reciprocating engine. In a regular reciprocating engine, the pistons are performing reciprocal motion, thereby causing great consumption of energy required to overcome the inertia of pistons in a change of the direction of their travel for an opposite one. In the course of operation of the rotary engine, pistons 4 through 7 are constantly traveling in the same direction, although at variable speeds; in so doing, consumption of energy required to overcome the inertia of pistons in a change of the sign of their acceleration for an opposite one is considerably lower, and hence the performance index of the rotary engine is much higher than in case of a regular one.

Figure 9:
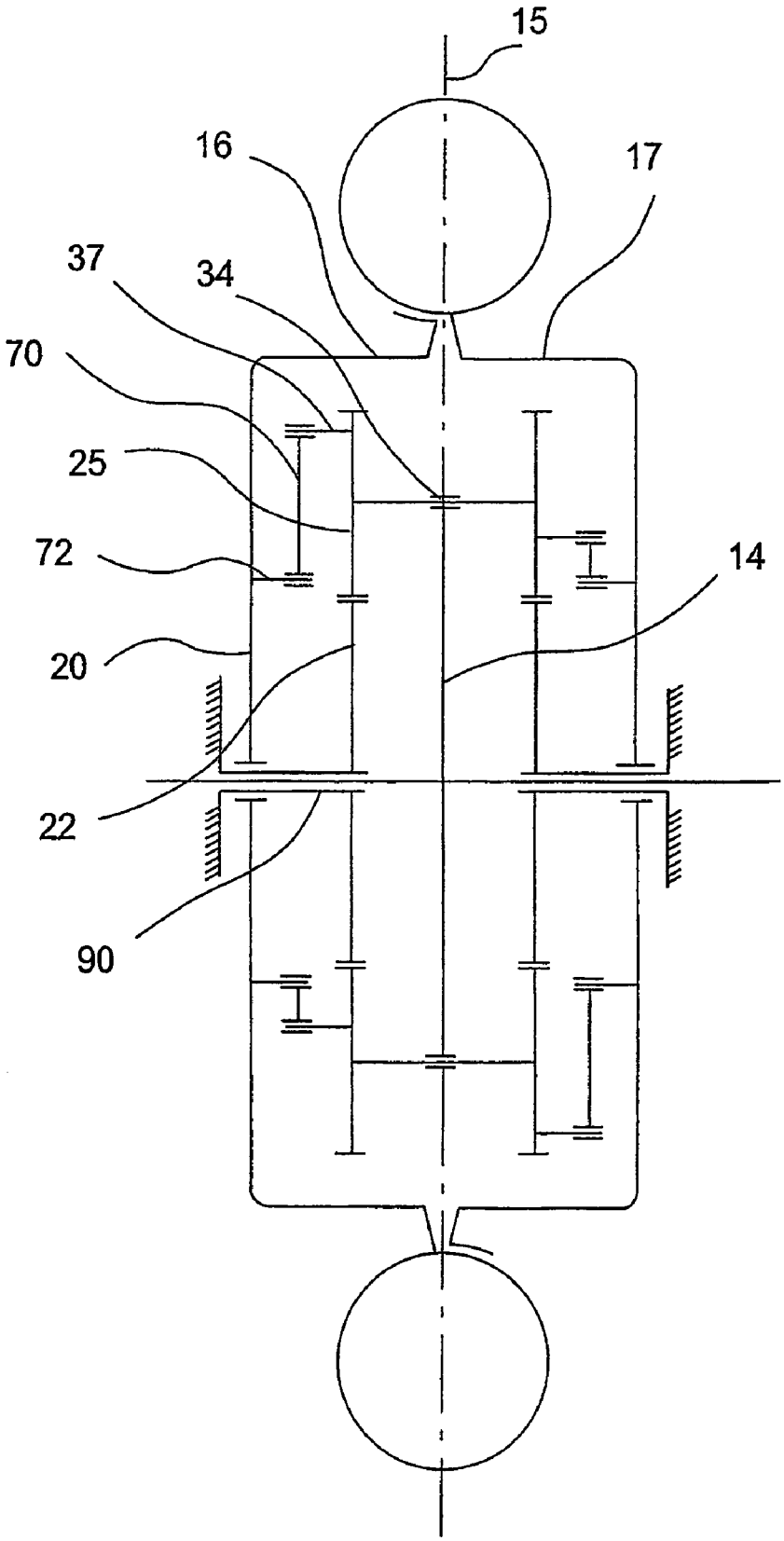
FIG. 9 shows the engine diagram with the flywheel disposed along the central plane of the working cylinder, while the bearing members are arranged between the side walls and the toothed gearwheels.

It is also possible to use a different arrangement of engine components (FIG. 9), wherein flywheel 14 is disposed in central plane 15 of circular slot 2, and bearing members are disposed behind gearwheels 22, 23 and between side walls 11, 12 of housing 1. FIG. 9 shows a diagram presenting flywheel 14, gearwheel 22, one satellite gear 25 with main journal 34 mounted for rotation in one of the openings provided in flywheel 14, and with cranikpin 37, and bearing member 16 with pin 72 fastened in wall 20, and crosshead coupler linik7O whose ends are mounted for rotation on cranikpin 37 and pin 72. Bearing members 16 and 17 are mounted for rotation on flanged bushings 90 of gearwheels 22 and 23, used for fastening these gearwheels on side walls 11 and 12 of housing 1. The engine having such arrangement of components operates similarly to the above-described one. It differs from the above engine in terms of a simpler design, method of manufacture, and assembling technology; however, bearing members 16 and 17 feature a greater axial length and complicate access to the components disposed therebetween.

Figure 10:
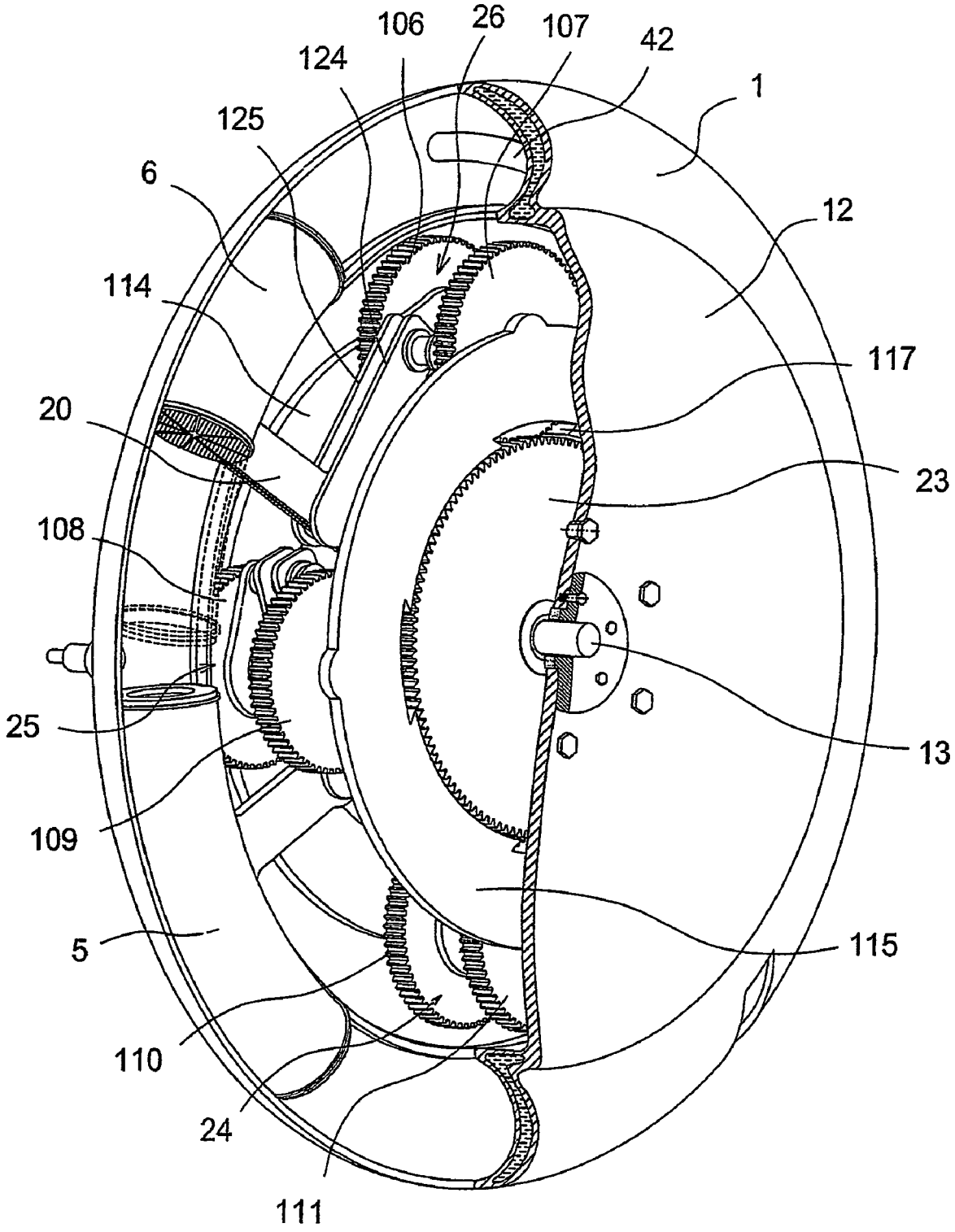
FIG. 10 shows axonometric view of the engine in which the satellite gears are made as twin gearwheels.

In another embodiment of the invention (FIGS. 10, 11), bearing members 16, 17 are disposed on both sides of central plane 15 of circular slot 2 and with a clearance between their walls 20 and 21 made in the form of plates connecting the pairs of pistons 4-6 and 5-7. Each of the satellite gears is composed of two twin gearwheels fastened on the main journals thereof on both sides of the pair of bearing members 16 and 17, and rigidly interconnected by a crankpin, one gearwheel of each satellite gear being meshed with toothed gearwheel 22, and the other gearwheel, with toothed gearwheel 23. Thus, satellite gear 24 is composed of two twin gearwheels 102 and 103, mounted on main journals 32 and **32*a* of said satellite gear with a gap therebetween and rigidly interconnected by crankpin 36, gearwheel 102 being meshed with toothed gearwheel 22, and gearwheel 103, with toothed gearwheel 23. Exactly in the same way, satellite gear 26 is composed of two twin gearwheels 106 and 107; satellite gear 25, of two twin gearwheels 108 and 109, and satellite gear 27, of two twin gearwheels 110 and 111, gearwheels 106, 108, and 109 being meshed with toothed gearwheel 22, and gearwheels 107, 109, and 111, with toothed gearwheel 23. Flywheel 14 is composed of two radially arranged discs 112 and 113, and two radially arranged rings 114 and 115, disc 112 being disposed between toothed gearwheel 22 and wall 20 of bearing member 16, and disc 113, between toothed gearwheel 23 and wall 21 of bearing member 17; ring 114, between side wall 11 of housing 10 and gearwheels 102, 106, 108, 110, and ring 115, between side wall 12 of housing 10 and gearwheels 103, 107, 109, 111. Ring 114 is coupled with disc 112 by four arc-shaped plates 116 passed between four points 117 of engagement between gearwheels 102, 106, 108, 110 and toothed gearwheel 22. Exactly in the same way, ring 115 is coupled with disc 113 by arc-shaped plates 118 passed between four points 119 of engagement between gearwheels 103, 107, 109, 111 and toothed gearwheel 23. Each of main journals 32 through 35 and 32*a* through 35*a* is mounted for rotation in coaxial openings of rings 114 and 115, axes of openings of all the four main journals being disposed at a uniform circular pitch. Crankpins 36 and 38 of satellite gears 24 and 26 are coupled with wall 20 of bearing member 16 by coupler links 120 and 121, and crankpins 37 and 39 of satellite gears 25 and 27 are coupled with wall 21 of bearing member 17 by coupler links 122 and 123. Each of coupler links 120 through 123 is disposed between twin gearwheels of respective satellite gears and consists of two parallel plates 124 and 125, rigidly interconnected at one ends thereof by pin 126 with formation of a gap therebetween, the opposite ends of these plates being provided with coaxial openings for crankpins 36 through 39. Coupler links 120 and 121 are mounted with pins thereof in the openings provided in wall 20 of bearing member 16, and coupler links 122 and 123, in the openings provided in the wall of bearing member 17. Crankpins 36 through 39 are passed through the coaxial openings provided at the other ends of plates 124, 125 of coupler links 120 through 123. Thus, coupler links 120 through 123 are mounted with one ends thereof, i.e. pins 126, for rotation in the openings provided in walls 20 and 21, and with other ends thereof, for rotation on crankpins 37 through 39. Here, walls 20 and 21 are disposed between plates 124 and 125 of coupler links 120 through 123. Arrangement and sizes of walls 20 and 21 of bearing members 16 and 17, made in the form of walls, are selected proceeding from the condition of lack of any contact between main journals 32, 32***a*, 34, 34*a* and crankpins 36, 38 of satellite gears 24 and 26, coupled with wall 20 of bearing member 16, in the course of relative motion of walls 20 and 21, and lack of any contact between main journals 33, 33*a*, 35, 35*a* and crankpins 37, 39 of satellite gears 25, 27, coupled with wall 21 of bearing member 17, with wall 20 of bearing member 16 in the course of their motion. When making the walls of bearing members 16 and 17 in the form of discs, each disc is provided with four ports whose arrangement and sizes are also selected proceeding from the condition of lack of any contact between main journals and crankpins of satellite gears, coupled with the disc of one bearing member, and the edges of the ports provided in the other bearing member.

In the course of engine operation, the load on the teeth of satellite gears 24 through 27 and toothed gearwheels 22, 23 from bearing members 16, 17 is equally distributed between gearwheels 102, 106, 108, 110, and their twin gearwheels 103, 107, 109, 111, thereby halving the load within meshes between satellite gears 24 through 27 and toothed gearwheels 22, 23, and hence allows to considerably reduce the sizes of these toothed members, and thereby to reduce radial sizes of the transmission gear. In addition, twin arrangement of satellite gears 24 through 27, their gearwheels being symmetrical relative to central plane 3 of cylinder 1, ensures symmetrical arrangement of masses of the transmission gear elements on both sides of central plane 3 of cylinder 1 both in axial and radial directions, and therefore considerably simplifies static and dynamic balancing of the engine, and reduces consumption of time and funds required for such balancing. This however somewhat complicates the design of the transmission gear and assembling of the engine. In all other respects, the engine operates similarly to the above-described embodiments thereof.

What is claimed is:

1. A rotary internal combustion engine comprising:

a hollow torus-shaped working cylinder and a through continuous circular slot with its walls symmetrically disposed relative to a central plane of the working cylinder around the smallest-diameter surface thereof;

an injector or a spark plug; an arc-shaped extended intake and exhaust ports disposed in the wall;

a circular housing with side walls symmetrically disposed relative to a central axis of the working cylinder and four pistons mounted in the working cylinder and shaped to conform to an internal surface of the cylinder and provided with compression and oil-scraper rings at end faces thereof;

an output shaft rotatably mounted within the side walls of the housing along the central axis of the working cylinder and a flywheel fastened on the output shaft or being integral therewith;

two bearing members symmetrically arranged on both sides of the central plane of the cylinder with a gap between respective walls of the bearing members, each of said bearing members comprising radially arranged disc-shaped C-wall and a ring rotatably mounted in the circular slot in tight contact between external surfaces of the rings and the compression and oil-scraper rings of the pistons, two of the four pistons being fastened in a diametrically opposite relationship on one ring, and two other pistons on the other ring, thereby forming inter-piston chambers between the pistons that are fastened on different bearing members;

a transmission gear comprising two toothed gearwheels in the form of external-mesh gearwheels fastened on the side walls of the housing and provided with axial openings for passage of the output shaft;

four satellite gears coupled with the flywheel, two of said satellite gears being in engagement with one toothed gearwheel and coupled with one bearing member, and two other gearwheels engaged with the other toothed gearwheel and coupled with the other bearing member, the axis of rotation of each satellite gear coupled with one bearing member being disposed between axes of rotation of the satellite gears coupled with the other bearing member;

eccentric members with main journals mounted inside flywheel openings coupling the satellite gears with the flywheel and the bearing members, the openings being parallel to the flywheel axis and to four crankpins coupled with the bearing members, the ratio between diameters of the satellite gears and the toothed gearwheels being 1:2;

wherein planes passing through axes of the main journals and crankpins of each pair of adjacent eccentric members intersecting at an angle of 90°, and a distance between crankpins in the areas of top and bottom dead centers being minimal;

wherein the transmission gear is provided with four eccentric members with main journals thereof mounted at a uniform pitch along circumference and are either fastened in the axial openings of the satellite gears or made integral therewith, and the crankpins are coupled with the bearing members by means of coupler links, each coupler link being mounted with the ends thereof for rotation on the crankpin and about the pin disposed in the wall of one of the bearing members;

and wherein the flywheel is disposed in the central plane of the cylinder, each toothed gearwheel being provided with a bushing fastened on the side wall of the housing, and the bearing members are mounted for rotation on the bushings of the toothed gearwheels between these gearwheels and housing side walls.

2. A rotary internal combustion engine comprising:

a hollow torus-shaped working cylinder and a through continuous circular slot with its walls symmetrically disposed relative to a central plane of the working cylinder around the smallest-diameter surface thereof;

an injector or a spark plug; an arc-shaped extended intake and exhaust ports disposed in the wall;

a circular housing with side walls symmetrically disposed relative to a central axis of the working cylinder and four pistons mounted in the working cylinder and shaped to conform to an internal surface of the cylinder and provided with compression and oil-scraper rings at end faces thereof;

an output shaft rotatably mounted within the side walls of the housing along the central axis of the working cylinder and a flywheel fastened on the output shaft or being integral therewith;

two bearing members symmetrically arranged relative to the central plane of the cylinder, each of the bearing members comprising radially arranged disc-shaped C-wall and a ring rotatably mounted in the circular slot in tight contact between external surfaces of the rings and the compression and oil-scraper rings of the pistons, two of the four pistons being fastened in a diametrically opposite relationship on one ring, and two other pistons on the other ring, thereby forming inter-piston chambers between the pistons that are fastened on different bearing members, a transmission gear comprising two toothed gearwheels in the form of external-mesh gearwheels fastened on the side walls of the housing and provided with axial openings for passage of the output shaft;

four satellite gears coupled with the flywheel, two of said satellite gears being in engagement with one toothed gearwheel and coupled with one bearing member, and two other gearwheels engaged with the other toothed gearwheel and coupled with the other bearing member, the axis of rotation of each satellite gear coupled with one bearing member being disposed between axes of rotation of the satellite gears coupled with the other bearing member;

eccentric members with main journals mounted inside flywheel openings coupling the satellite gears with the flywheel and the bearing members, the openings being parallel to the flywheel axis and to four crankpins coupled with the bearing members, the ratio between diameters of the satellite gears and the toothed gearwheels being 1:2;

wherein planes passing through axes of the main journals and crankpins of each pair of adjacent eccentric members intersecting at an angle of 90°, and a distance between crankpins in the areas of top and bottom dead centers being minimal;

wherein the transmission gear is provided with four eccentric members with main journals thereof mounted at a uniform pitch along circumference and are either fastened in the axial openings of the satellite gears or made integral therewith, and the crankpins are coupled with the bearing members by means of coupler links, each coupler link being mounted with the ends thereof for rotation on the cranikpin and about the pin disposed in the wall of one of the bearing members;

and wherein external surfaces of the rings of the bearing members are made along the moving line in the shape of a circular arc having a diameter equal to the diameter of the internal surface of the working cylinder, and the rings are mounted in the circular slot, external surfaces thereof forming an extension of the internal surface of the cylinder.

3. A rotary internal combustion engine comprising:

a hollow torus-shaped working cylinder and a through continuous circular slot with its walls symmetrically disposed relative to a central plane of the working cylinder around the smallest-diameter surface thereof;

an injector or a spark plug; an arc-shaped extended intake and exhaust ports disposed in the wall;

a circular housing with side walls symmetrically disposed relative to a central axis of the working cylinder and four pistons mounted in the working cylinder and shaped to conform to an internal surface of the cylinder and provided with compression and oil-scraper rings at end faces thereof;

an output shaft rotatably mounted within the side walls of the housing along the central axis of the working cylinder and a flywheel fastened on the output shaft or being integral therewith;

two bearing members symmetrically arranged relative to the central plane of the cylinder, each of the bearing members comprising radially arranged disc-shaped C-wall and a ring rotatably mounted in the circular slot in tight contact between external surfaces of the rings and the compression and oil-scraper rings of the pistons, two of the four pistons being fastened in a diametrically opposite relationship on one ring, and two other pistons on the other ring, thereby forming inter-piston chambers between the pistons that are fastened on different bearing members; a transmission gear comprising two toothed gearwheels in the form of external-mesh gearwheels fastened on the side walls of the housing and provided with axial openings for passage of the output shaft;

four satellite gears coupled with the flywheel, two of said satellite gears being in engagement with one toothed gearwheel and coupled with one bearing member, and two other gearwheels engaged with the other toothed gearwheel and coupled with the other bearing member, the axis of rotation of each satellite gear coupled with one bearing member being disposed between axes of rotation of the satellite gears coupled with the other bearing member;

eccentric members with main journals mounted inside flywheel openings coupling the satellite gears with the flywheel and the bearing members, the openings being parallel to the flywheel axis and to four crankpins coupled with the bearing members, the ratio between diameters of the satellite gears and the toothed gearwheels being 1:2;

wherein planes passing through axes of the main journals and crankpins of each pair of adjacent eccentric members intersecting at an angle of 90°, and a distance between crankpins in the areas of top and bottom dead centers being minimal;

wherein the transmission gear is provided with four eccentric members with main journals thereof mounted at a uniform pitch along circumference and are either fastened in the axial openings of the satellite gears or made integral therewith, and the crankpins are coupled with the bearing members by means of coupler links, each coupler link being mounted with the ends thereof for rotation on the crankpin and about the pin disposed in the wall of one of the bearing members;

and wherein external surface of each piston is made along the moving line in the shape of circumference, and provided with a rectilinear section facing the circular slot, the width of said section being equal to the width of the circular slot, and external surfaces of the rings are disposed along the moving lines in the shape of rectilinear lengths.

4. A rotary internal combustion engine comprising:

a hollow torus-shaped working cylinder and a through continuous circular slot with its walls symmetrically disposed relative to a central plane of the working cylinder around the smallest-diameter surface thereof;

an injector or a spark plug; an arc-shaped extended intake and exhaust ports disposed in the wall;

a circular housing with side walls symmetrically disposed relative to a central axis of the working cylinder and four pistons mounted in the working cylinder and shaped to conform to an internal surface of the cylinder and provided with compression and oil-scraper rings at end faces thereof;

an output shaft rotatably mounted within the side walls of the housing along the central axis of the working cylinder and a flywheel fastened on the output shaft or being integral therewith;

two bearing members symmetrically arranged on both sides of the central plane of the cylinder with a gap between respective walls of the bearing members, each of the bearing members comprising radially arranged disc-shaped C-wall and a ring rotatably mounted in the circular slot in tight contact between external surfaces of the rings and the compression and oil-scraper rings of the pistons two of the four pistons being fastened in a diametrically opposite relationship on one ring, and two other pistons on the other ring, thereby forming inter-piston chambers between the pistons that are fastened on different bearing members;

a transmission gear comprising two toothed gearwheels in the form of external-mesh gearwheels fastened on the side walls of the housing and provided with axial openings for passage of the output shaft;

four satellite gears coupled with the flywheel, two of said satellite gears being in engagement with one toothed gearwheel and coupled with one bearing member, and two other gearwheels engaged with the other toothed gearwheel and coupled with the other bearing member, the axis of rotation of each satellite gear coupled with one bearing member being disposed between axes of rotation of the satellite gears coupled with the other bearing member;

eccentric members with main journals mounted inside flywheel openings coupling the satellite gears with the flywheel and the bearing members, the openings being parallel to the flywheel axis and to four crankpins coupled with the bearing members, the ratio between diameters of the satellite gears and the toothed gearwheels being 1:2;

wherein the planes passing through axes of the main journals and crankpins of each pair of adjacent eccentric members intersecting at an angle of 90°, and a distance between crankpins in the areas of top and bottom dead centers being minimal, wherein the transmission gear is provided with four eccentric members with main journals thereof mounted at a uniform pitch along circumference and are either fastened in the axial openings of the satellite gears or made integral therewith, and the crankpins are coupled with the bearing members by means of coupler links, each coupler link being mounted with the ends thereof for rotation on the crankpin and about the pin disposed in the wall of one of the bearing members;

and wherein the flywheel is composed of two radially arranged discs, each of said discs being disposed between one of the toothed gearwheels and one of the bearing members; and two radially arranged rings, each of them being disposed between one of the housing side walls and one pair of the satellite gears, and being coupled with one of the discs by means of two arc-shaped plates passed between the points of engagement of toothed gearwheels and satellite gears, the main journals of the satellite gears meshed with one toothed gearwheel being mounted in the openings of one ring, and the main journals of the satellite gears meshed with the other toothed gearwheel, in the openings of the other ring.

5. A rotary internal combustion engine comprising:

a hollow torus-shaped working cylinder and a through continuous circular slot with its walls symmetrically disposed relative to a central plane of the working cylinder around the smallest-diameter surface thereof;

an injector or a spark plug; an arc-shaped extended intake and exhaust ports disposed in the wall;

a circular housing with side walls symmetrically disposed relative to a central axis of the working cylinder and four pistons mounted in the working cylinder and shaped to conform to an internal surface of the cylinder and provided with compression and oil-scraper rings at end faces thereof;

an output shaft rotatably mounted within the side walls of the housing along the central axis of the working cylinder and a flywheel fastened on the output shaft or being integral therewith;

two bearing members symmetrically arranged on both sides of the central plane of the cylinder with a gap between respective walls of the bearing members, each of the bearing members comprising radially arranged disc-shaped C-wall and a ring rotatably mounted in the circular slot in tight contact between external surfaces of the rings and the compression and oil-scraper rings of the pistons, two of the four pistons being fastened in a diametrically opposite relationship on one ring, and two other pistons on the other ring, thereby forming inter-piston chambers between the pistons that are fastened on different bearing members; a transmission gear comprising two toothed gearwheels in the form of external-mesh gearwheels fastened on the side walls of the housing and provided with axial openings for passage of the output shaft;

four satellite gears coupled with the flywheel, two of said satellite gears being in engagement with one toothed gearwheel and coupled with one bearing member, and two other gearwheels engaged with the other toothed gearwheel and coupled with the other bearing member, the axis of rotation of each satellite gear coupled with one bearing member being disposed between axes of rotation of the satellite gears coupled with the other bearing member;

eccentric members with main journals mounted inside flywheel openings coupling the satellite gears with the flywheel and the bearing members, the openings being parallel to the flywheel axis and to four crankpins coupled with the bearing members, the ratio between diameters of the satellite gears and the toothed gearwheels being 1:2;

wherein planes passing through axes of the main journals and crankpins of each pair of adjacent eccentric members intersecting at an angle of 90°, and a distance between crankpins in the areas of top and bottom dead centers being minimal;

wherein the transmission gear is provided with four eccentric members with main journals thereof mounted at a uniform pitch along circumference and are either fastened in the axial openings of the satellite gears or made integral therewith, and the crankpins are coupled with the bearing members by means of coupler links, each coupler link being mounted with the ends thereof for rotation on the crankpin and about the pin disposed in the wall of one of the bearing members;

and wherein the flywheel is composed of two radially arranged discs and two radially arranged rings, each of the discs being disposed between one of the toothed gearwheels and one of the bearing members, and each of the rings, between one of the housing side walls and the satellite gears, and coupled with one of the discs by means of four arc-shaped plates passed between four points of engagement of toothed gearwheels and satellite gears, each of the satellite gears being composed of two twin gearwheels fastened on the main journal thereof on the both sides of the pair of the bearing members and rigidly connected therebetween by crankpins, the main journals of each of the satellite gears being mounted in coaxial openings of both rings of the flywheel; one of the twin gearwheels is meshed with one of the toothed gearwheels, and the other gearwheel, with the other toothed gearwheel; the coupler link connecting each of the satellite gears with the bearing member is disposed in the gap provided between the twin gearwheels of the satellite gear and is composed of two parallel plates that are rigidly interconnected with formation of a gap therebetween, said gap enclosing the wall of the bearing member, connected with this satellite gear, the walls of the bearing members being made in the shape of plates or discs connecting the piston pairs, each of the discs being provided with four openings, arrangement and sizes of the plates or openings provided in the discs being chosen proceeding from the condition of absence of any contacts between main journals and crankpins of the satellite gears connected with one bearing member, and plates or edges of openings provided in the discs of the other bearing member in the course of the relative travel of the bearing members.

* * * * *